US009682567B2

(12) United States Patent
Marra

(10) Patent No.: US 9,682,567 B2
(45) Date of Patent: Jun. 20, 2017

(54) PRINT CARTRIDGE AND AN INKJET PRINTER

(71) Applicant: FUNAI ELECTRIC CO., LTD., Osaka (JP)

(72) Inventor: Michael Marra, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/519,921

(22) Filed: Oct. 21, 2014

(65) Prior Publication Data

US 2016/0107449 A1 Apr. 21, 2016

(51) Int. Cl.
*B41J 2/175* (2006.01)

(52) U.S. Cl.
CPC ..... *B41J 2/1753* (2013.01); *B41J 2/17546* (2013.01); *B41J 2/17559* (2013.01)

(58) Field of Classification Search
USPC ..... 347/85, 86, 7; 702/173
See application file for complete search history.

(56) References Cited

U.S. PATENT DOCUMENTS

| | | | | |
|---|---|---|---|---|
| 6,385,407 | B1 | 5/2002 | Inose | |
| 6,409,325 | B1 | 6/2002 | Matsumoto et al. | |
| 6,808,255 | B1 * | 10/2004 | Haines et al. | 347/86 |
| 6,969,136 | B1 | 11/2005 | Matsumoto et al. | |
| 6,973,409 | B1 * | 12/2005 | Shimizu et al. | 702/173 |
| 7,014,305 | B2 * | 3/2006 | Matsumoto et al. | 347/86 |
| 2002/0057319 | A1 | 5/2002 | Saruta et al. | |
| 2004/0233245 | A1 | 11/2004 | Matsumoto et al. | |
| 2006/0268028 | A1 | 11/2006 | Saruta et al. | |
| 2008/0186369 | A1 | 8/2008 | Lyles | |

FOREIGN PATENT DOCUMENTS

| | | |
|---|---|---|
| EP | 1661710 | 5/2006 |
| EP | 2230083 | 9/2010 |
| JP | 200635483 | 2/2006 |
| JP | 2007253396 | 10/2007 |

* cited by examiner

*Primary Examiner* — Lam Nguyen
(74) *Attorney, Agent, or Firm* — Amster, Rothstein & Ebenstein, LLP

(57) ABSTRACT

A print cartridge including a cartridge body, a fluid reservoir disposed within the cartridge body that receives and contains fluid, a fluid ejector chip comprising a plurality of heating elements that eject the fluid from the print cartridge, and a memory device that stores first data related to information regarding the number of times the print cartridge was remanufactured and second data related to information regarding the print yield of the print cartridge for each instance of cartridge remanufacture.

8 Claims, 3 Drawing Sheets

PRINT CARTRIDGE AND AN INKJET PRINTER

FIELD

This invention is related to inkjet printheads, and in particular, to systems and methods for determining yield of inkjet printheads.

BACKGROUND

Remanufactured—or recycled—printer cartridges are sent to a manufacturer who will restock the ink and replace or repair any parts that are damaged or not working correctly. When an inkjet cartridge is remanufactured or refilled, often the amount of ink in the remanufactured cartridge is not equivalent to the amount of ink that was provided by the original fill of that cartridge. This can be for a variety of reasons, including but not limited to the ink fill capability of the remanufacturer, technical issues with the used cartridge that may reduce the amount of ink it is capable of holding after remanufacture, and also simply the amount of ink the remanufacturer wishes to fill.

When this remanufactured cartridge is installed in a printer, there is a need for the printer to know how much ink is remaining in the cartridge. This information is used to provide a gauge to track ink remaining which can be communicated to the user. This information can also be used to indicate when a new cartridge should be purchased or shipped to the customer, or to disable function of the cartridge when a certain amount of ink has been used (i.e., if cartridge is empty).

Since the ink filled into a cartridge during remanufacture is not necessarily equivalent to the ink filled originally, the printer will be unable to determine this information for the remanufactured cartridge based on the information originally programmed into the cartridge memory.

SUMMARY OF THE INVENTION

An object of the present invention is to provide a means to refill a cartridge with an arbitrary amount of ink. This amount of ink does not have to be related to the amount filled in the original cartridge.

This is accomplished by providing fields in the memory map of the inkjet cartridge that are programmed at the time of remanufacture. These fields are used by the printer FW when the reman cartridge is installed to determine the amount of ink in the remanufactured cartridge.

A print cartridge according to an exemplary embodiment of the present invention comprises: a cartridge body; a fluid reservoir disposed within the cartridge body that receives and contains fluid; a fluid ejector chip comprising a plurality of heating elements that eject the fluid from the print cartridge; and a memory device that stores first data related to information regarding the number of times the print cartridge was remanufactured and second data related to information regarding the print yield of the print cartridge for each instance of cartridge remanufacture.

An inkjet printer according to an exemplary embodiment of the present invention comprises: a housing; a carriage adapted to reciprocate along a shaft disposed within the housing; one or more printhead assemblies arranged on the carriage so that the one or more printhead assemblies eject ink onto a print medium as the carriage reciprocates along the shaft in accordance with a control mechanism, wherein at least one of the one or more printhead assemblies comprises: a printhead cartridge comprising: a cartridge body; an ink reservoir disposed within the cartridge body that receives and contains ink; an ink ejector chip comprising a plurality of heating elements that eject the ink from the ink reservoir; and a memory device that stores first data related to information regarding the number of times the printhead cartridge was remanufactured and second data related to information regarding the print yield of the printhead cartridge for each instance of cartridge remanufacture.

According to at least one embodiment, the first data comprises one or more first data fields, each first data field comprising a data bit set to indicate whether the print cartridge is either new or remanufactured.

According to at least one embodiment, the number of data bits set to indicate that the print cartridge is remanufactured corresponds to the number of times the print cartridge was remanufactured.

According to at least one embodiment, the second data comprises one or more second data fields, each data field corresponding to an instance of cartridge remanufacture and comprising one or more data bits that indicate print yield for the instance of cartridge remanufacture.

According to at least one embodiment, the print yield corresponds to the maximum number of pages that can be printed using the print cartridge.

According to at least one embodiment, the print yield corresponds to the maximum amount of fluid that can be ejected from the print cartridge.

According to at least one embodiment, the print yield corresponds to the maximum number of drop counts of fluid ejected from the print cartridge.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
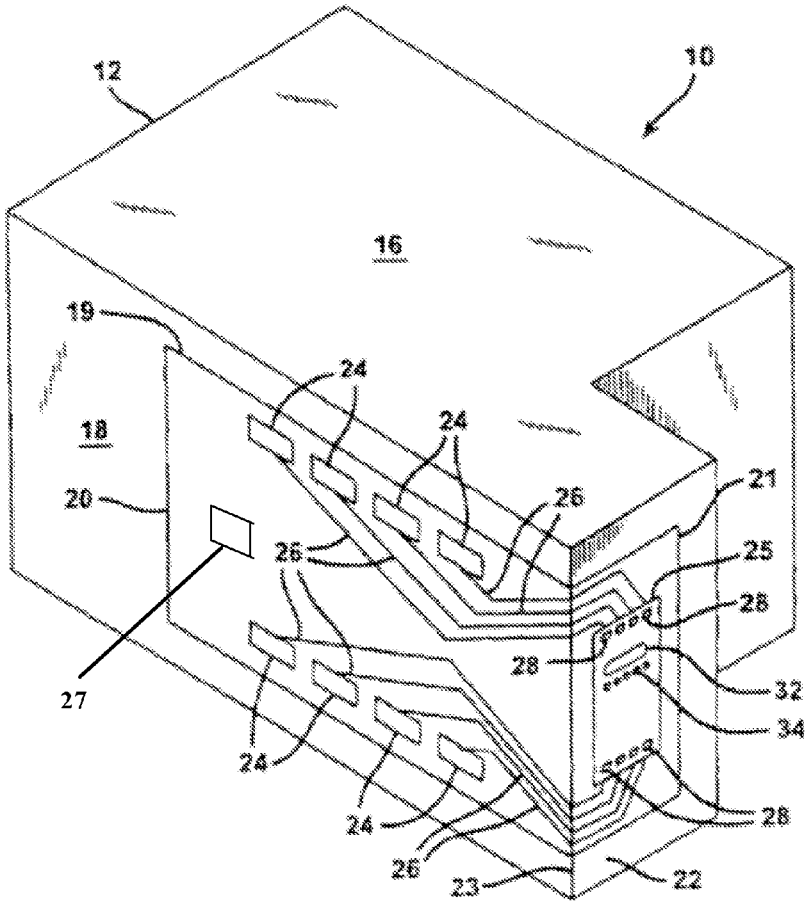
FIG. 1 is a perspective view of an inkjet printhead according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1, an inkjet printhead according to an exemplary embodiment of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of $1/300_{th}$, $1/600_{th}$, $1/1200_{th}$, $1/2400_{th}$ or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

A memory unit 27 stores data related to information such as, for example, the production date, the lifetime and the number of refilled times that can be made.

Figure 2:
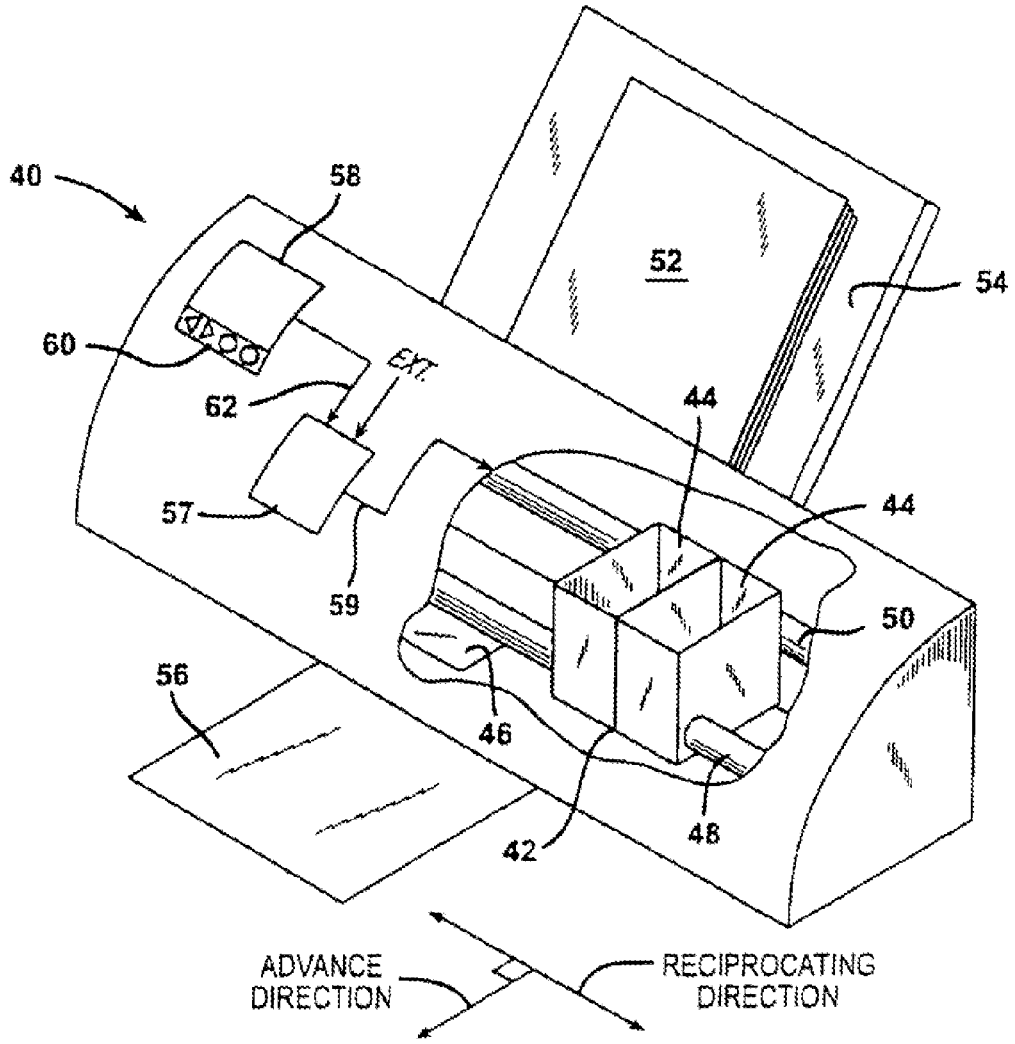
FIG. 2 is a perspective view of an inkjet printer according to an exemplary embodiment of the present invention.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Since the ink filled into a remanufactured cartridge is not necessarily equivalent to the ink filled originally, a printer will be unable to determine certain information for the remanufactured cartridge based on the information originally programmed into the cartridge memory. Such information may include, for example, how much ink is remaining in the cartridge, which in turn can be used to indicate when a new cartridge should be purchased or shipped to the customer, or to disable function of the cartridge when a certain amount of ink has been used (i.e., if cartridge is empty).

Exemplary embodiments of the present invention provide such information by including multiple fields in the memory unit 27 so that the printer can determine the ink remaining in the original cartridge as well as the same cartridge after it has been remanufactured.

For example, Table 1 below summarizes one possible implementation of the present invention. Each field has a specified number of bits reserved in the memory on the cartridge, with each bit representing a number of pages. The number of fields may correspond to the maximum number of times the printhead can be used. For example, the presence of three fields indicates that the cartridge can be remanufactured only twice. If N is the number of bits, and 50 page increments are desired, the maximum number of pages may be calculated as follows:

$$\text{Total No. of Pages}=2^N*50 \quad (1)$$

In alternative exemplary embodiments, each bit may represent other variables, such as, for example, grams of ink, or drop counts related to the ink filled.

TABLE 1

| Field Name | Number of bits | Max at 50 pages/bit | Field Description |
|---|---|---|---|
| Original Yield | 4 | 800 | The number of pages provided by the original production of the cartridge, using the original ink fill amount. This is programmed at the time of original manufacture. |
| Reman 1 Yield | 4 | 800 | The number of pages that this cartridge will provide after the $1^{st}$ reman operation. This field is programmed at the time of $1^{st}$ remanufacture. |
| Reman 2 Yield | 4 | 800 | The number of pages that this cartridge will provide after the $2^{nd}$ reman operation. This field is programmed at the time of $2^{nd}$ remanufacture. |

The information of remanufactured yield could be used in conjunction with fields that indicate if the cartridge is new or used, or if it has been remanufactured. For example, if 3 bits are allocated to indicate a cartridge has been used (i.e., New/Used 1, New/Used 2, New/Used 3), each bit corresponding to an event of a cartridge install into a printer, the printer may use this information to determine which yield bits to use. For example, if all bits indicate New, then the cartridge is new, and the printer should use the field for Original Yield (and then set the New/Used 1 bit to indicate Used). If New/Used 1 indicates Used at install and the others indicate New, the cartridge was used once and remanufactured, so the printer should look at the Reman 1 Yield bits to obtain information on the amount of ink filled in the cartridge. If a more secure remanufacturing operation is required, additional fields may also be used to determine which Yield bits to use. Table 2 summarizes a possible implementation of this procedure:

TABLE 2

| New/Used 1 | New/Used 2 | New/Used 3 | State |
|---|---|---|---|
| 0 | 0 | 0 | Cartridge is new, use Original Yield |
| 1 | 0 | 0 | Cartridge used once, reman once, use Reman 1 Yield |
| 1 | 1 | 0 | Cartridge used twice, reman twice, use Reman 2 Yield |
| 1 | 1 | 1 | Cartridge used 3 times, no more reman allowed |

All other cases are invalid

Figure 3:
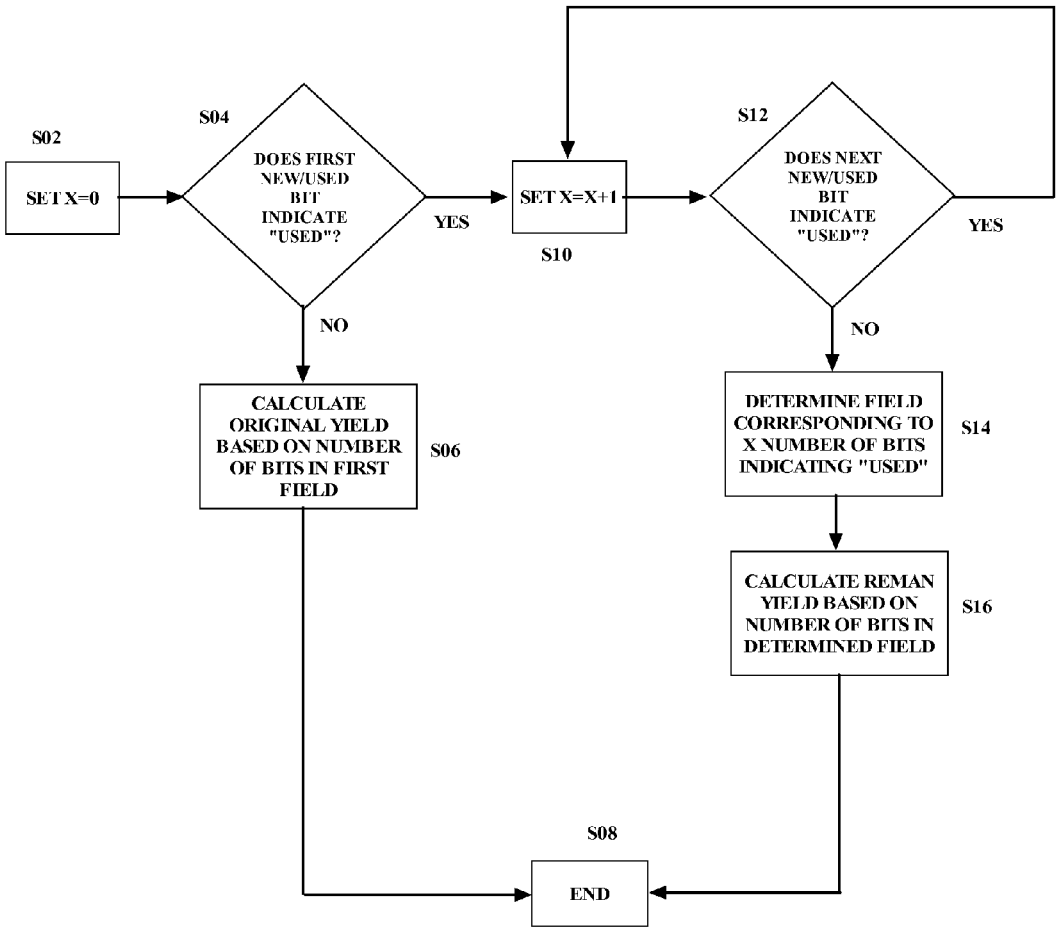
FIG. 3 is a flowchart illustrating a method of determining the yield of a print cartridge upon installation into a printer according to an exemplary embodiment of the present invention.

FIG. 3 is a flowchart illustrating a method of determining the yield of a print cartridge upon installation into a printer according to an exemplary embodiment of the present invention. The method begins at Step S02, where X is set equal to zero. At step S04, it is determined whether the first New/Used Bit is set to "1" (used) or "0" (new). If the first New/Used Bit is set to "0", then the method proceeds to Step S06, where the original yield is calculated. In this step, the original yield is determined by referencing the number of bits in the original yield field (Table 1) and using Equation 1. The process then ends at Step S08.

If it is determined in Step S04 that the first New/Used Bit is set equal to "1" (used), the method proceeds to step S10, where X is set equal to X+1. Next, in Step S12, it is determined whether the next New/Used Bit is set to "1" (used) or "0" (new). If the next New/Used Bit is set to "1", the method returns to Step S10, where X is again set equal to X+1.

If it is determined in Step S12 that the next New/Used Bit is set to "0", the method proceeds to Step S14, where the field corresponding to the "X" number of bits set to "1" is determined (Table 2). Then, in Step S16, the yield of the remanufactured cartridge is determined based on the number of bits in the determined field (Table 1) and Equation 1. The process then ends at Step S08.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A print cartridge comprising:

a cartridge body;

a fluid reservoir disposed within the cartridge body that receives and contains fluid;

a fluid ejector chip comprising a plurality of heating elements that eject the fluid from the print cartridge; and a memory device that stores print yield data related to information regarding a print yield of the print cartridge at a time of cartridge remanufacture for each instance of cartridge remanufacture, wherein the print yield corresponds to one of the group consisting of: a number of pages that can be printed using the print cartridge, an amount of fluid that can be ejected from the print cartridge, and a number of drop counts of fluid ejected from the print cartridge, and wherein the print yield data comprises a predetermined number of data fields corresponding to a maximum number of cartridge remanufactures.

2. The print cartridge of claim 1, wherein the first data comprises one or more first data fields, each first data field comprising a data bit set to indicate whether the print cartridge is either new or remanufactured.

3. The print cartridge of claim 2, wherein the number of data bits set to indicate that the print cartridge is remanufactured corresponds to the number of times the print cartridge was remanufactured.

4. The print cartridge of claim 1, wherein each data field corresponds to an instance of cartridge remanufacture and comprising one or more data bits that indicate print yield for the respective instance of cartridge remanufacture.

5. An inkjet printer comprising:

a housing;

a carriage adapted to reciprocate along a shaft disposed within the housing;

one or more printhead assemblies arranged on the carriage so that the one or more printhead assemblies eject ink onto a print medium as the carriage reciprocates along the shaft in accordance with a control mechanism, wherein at least one of the one or more printhead assemblies comprises:

a printhead cartridge comprising:

a cartridge body;

an ink reservoir disposed within the cartridge body that receives and contains ink;

an ink ejector chip comprising a plurality of heating elements that eject the ink from the ink reservoir; and a memory device that stores print yield data related to information regarding a print yield of the printhead cartridge at a time of cartridge remanufacture for each instance of cartridge remanufacture, wherein the print yield corresponds to one of the group consisting of: a number of pages that can be printed using the print cartridge, an amount of fluid that can be ejected from the print cartridge, and a number of drop counts of fluid ejected from the print cartridge, and wherein the print yield data comprises a predetermined number of data fields corresponding to a maximum number of cartridge remanufactures.

6. The inkjet printer of claim 5, wherein the first data comprises one or more first data fields, each first data field comprising a data bit set to indicate whether the printhead cartridge is either new or remanufactured.

7. The inkjet printer of claim 6, wherein the number of data bits set to indicate that the printhead cartridge is remanufactured corresponds to the number of times the printhead cartridge was remanufactured.

8. The inkjet printer of claim 5, wherein each data field corresponds to an instance of cartridge remanufacture and comprising one or more data bits that indicate print yield for the respective instance of cartridge remanufacture.

* * * * *